United States Patent [19]

Field

[11] 4,193,705

[45] Mar. 18, 1980

[54] SUSPENSION DEVICE

[76] Inventor: Geoffrey D. Field, 3 Pillans Rd., Rosebank, Cape Town, South Africa

[21] Appl. No.: 828,669

[22] Filed: Aug. 29, 1977

[30] Foreign Application Priority Data

Aug. 27, 1976 [ZA] South Africa ..... 765163

[51] Int. Cl.[2] ..... B42F 3/04; B42F 15/06; B42F 13/14

[52] U.S. Cl. ..... 402/46; 402/48; 402/12

[58] Field of Search ..... 402/46, 47, 48, 50, 402/12

[56] References Cited

U.S. PATENT DOCUMENTS

| | | | |
|---|---|---|---|
| 676,217 | 6/1901 | Briggs | 402/46 |
| 1,100,548 | 6/1914 | Eilers et al. | 402/48 |
| 1,101,780 | 6/1914 | Blaylock | 402/46 |
| 1,660,543 | 2/1928 | Buchan | 402/12 |
| 1,788,303 | 1/1931 | Jennings | 402/46 |
| 4,113,394 | 9/1978 | Giulie | 402/46 |

FOREIGN PATENT DOCUMENTS

| | | | |
|---|---|---|---|
| 1467172 | 12/1966 | France | 204/46 |

*Primary Examiner*—Donald R. Schran
*Attorney, Agent, or Firm*—Larson, Taylor and Hinds

[57] ABSTRACT

A suspension device for vertical suspension of sheets, such as drawing sheets, which includes two substantially parallel bars; a number of pins on each bar, each pin being connected at one end to its bar with its free end directed to the other bar, the pins being adapted to be inserted through holes provided along edges of sheets so that the sheets can suspend from the pins; locating means provided on each bar for locating the free ends of the pins relative to the other bar; and locking means for releasably holding the two bars in a locked position in which the free ends of the pins are located in the associated locating means.

4 Claims, 18 Drawing Figures

Figure 16:
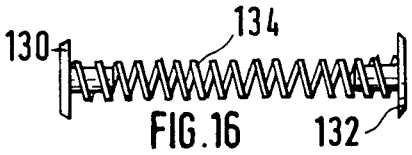

FIG. 1
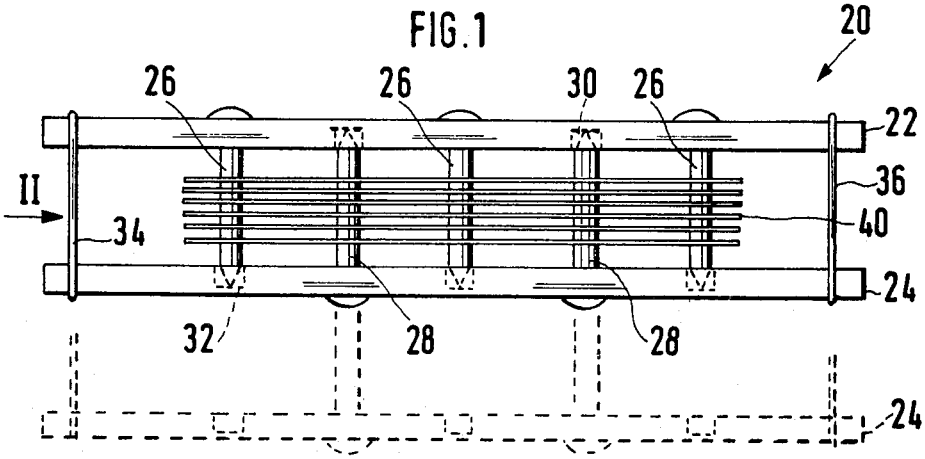
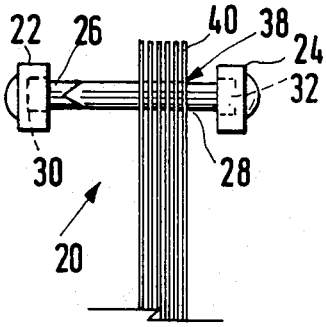
FIG. 2
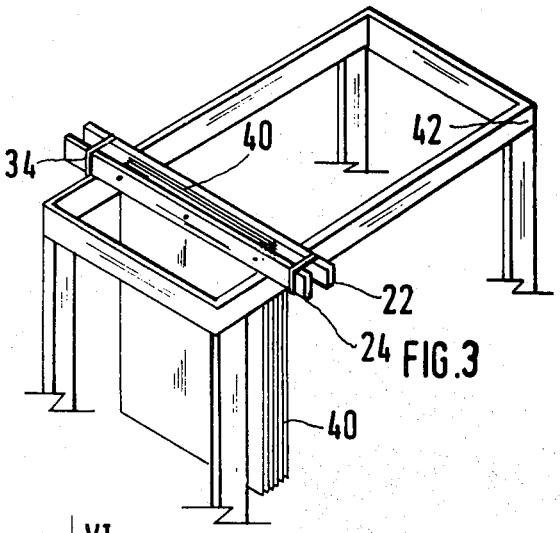
FIG. 3
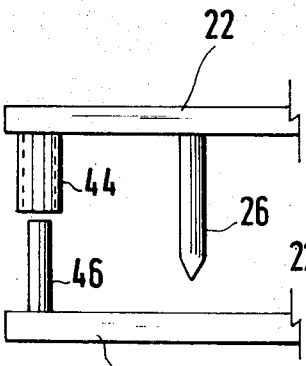
FIG. 4
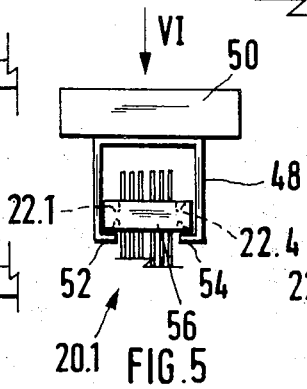
FIG. 5
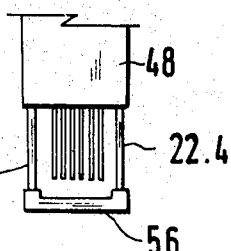
FIG. 6

FIG.8
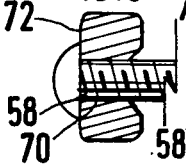
FIG.9
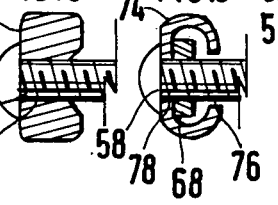
FIG.10
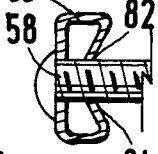
FIG.11
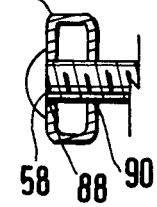
FIG.7
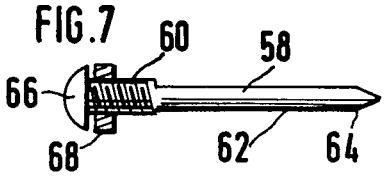
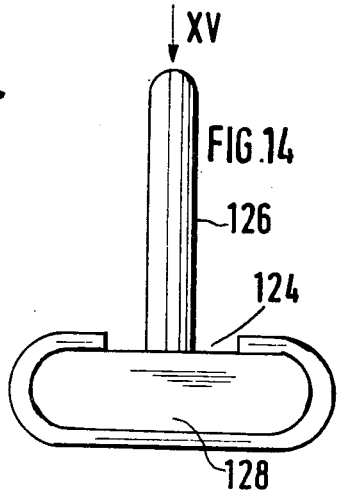
FIG.14
FIG.12
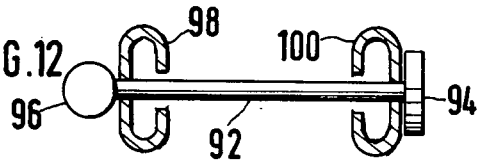
FIG.15
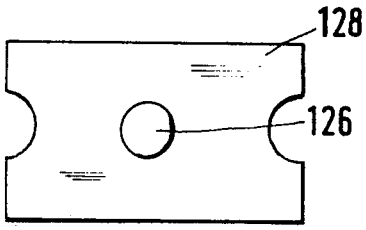

SUSPENSION DEVICE

The present invention relates to a suspension device for drawing sheets.

More particularly, the invention relates to a suspension device for sets of drawing sheets, in which the set size may be changed easily without loss of order and in which a set may be easily moved.

According to the invention, a suspension device for vertical suspension of sheets, such as drawing sheets, includes (a) two hollow elongated bars, each bar having a longitudinal slot the sides of which are shaped to retain a block longitudinally slidably inside the bar;

(b) a number of blocks slidably provided in each bar;

(c) at least one pin allocated to each block, each pin being connected at one end to its block and the pin passing through the longitudinal slot of the bar, in which its block is slidably provided, with its opposite free end being directed towards the longitudinal slot of the opposite bar, each pin being adapted to be inserted through one of a series of holes provided along edges of sheets so that the sheets can suspend from the pins;

(d) locating means provided on each bar for locating the free ends of the pins relative to the other bar; and (e) locking means for releasably holding the two bars in a locked position in which the free ends of the pins are located in the associated locating means.

The longitudinal slot of each bar may constitute the locating means for receiving the free ends of the pins provided on blocks in the opposite bar.

The locking means may include biasing means for biasing the two bars towards each other.

The biasing means may be adapted to allow movement of the bars from a closed position, in which the free ends of the pins are located in the locating means, into an open position, in which the bars are separated from each other at such a distance that there is a gap between the free ends of the pins provided in one bar and the pins provided on the other bar.

The invention will now be described by way of example with reference to the accompanying schematic drawings.

In the drawings there is shown in

Figure 13:
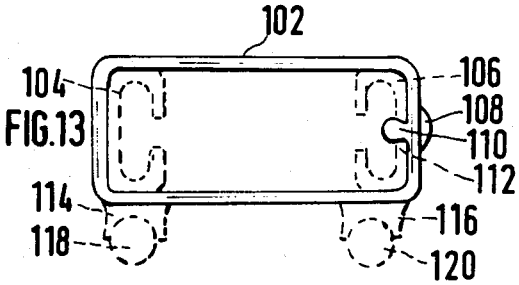
Figure 17:
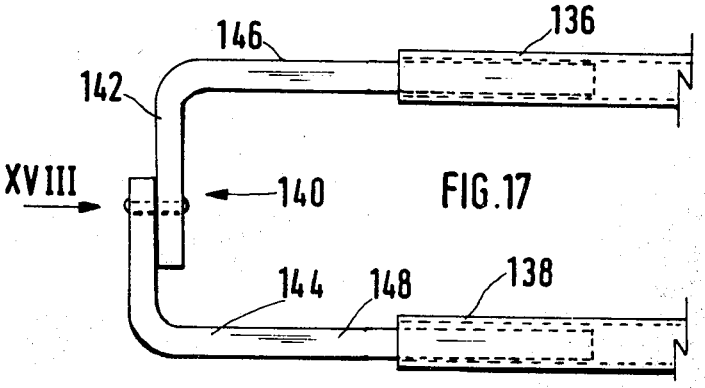

FIG. 1 a plan view of a suspension device in accordance with the invention;

FIG. 2 an end view of the device seen along arrow II in FIG. 1 but with the bars slightly withdrawn;

FIG. 3 a perspective view of the device of FIGS. 1 and 2 as supported on support rails;

FIG. 4 a plan view on the end of a set of bars showing one form of guide means;

FIG. 5 an end view of one type of support rail for receiving the suspension device;

FIG. 6 a plan view on the support rail of FIG. 5 seen along arrow VI;

FIG. 7 a side view of one type of pin;

FIGS. 8 to 11 a sectional end view of various bars provided with pins;

FIG. 12 an end view of one type of locking means;

FIG. 13 and end view of another type of locking means;

FIG. 14 a side view of one type of pin;

FIG. 15 a plan view of the pin seen along arrow XV in FIG. 14;

FIG. 16 a side view of one type of biassing means;

FIG. 17 a plan view of another type of biassing means; and

Figure 18:
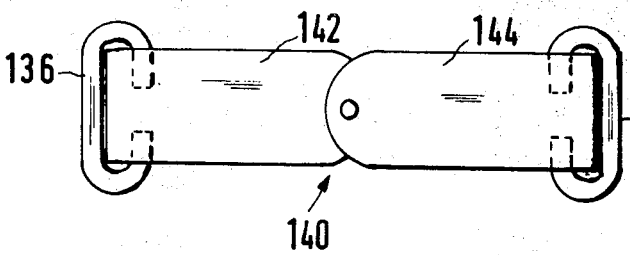

FIG. 18 an end view of the biassing means of FIG. 17 seen along arrow XVIII.

Referring to FIGS. 1 to 3, the suspension device 20 includes two elongated support bars 22, 24. Each of these bars is provided with a number of support pins or spikes 26, 28. These support pins are parallel and point towards the opposite bar. The free ends of the pins 26, 28 are respectively adapted to be located in locating recesses 30 and 32 provided in the bars 22, 24 when the bars 22, 24 are pulled towards each other by means of elastic biassing bands 34, 36 acting at the ends of the bars 22, 24.

The pins 26, 28 pass through holes at 38 provided along the edges of drawing sheets 40 (see FIG. 2).

The drawing sheets 40 are suspended from the pins 26, 28. When the elastic bands 34, 36 are in tension, they pull the pins 26, 28 together so as to be located in the respective recesses 30, 32. Whenever a drawing sheet 40 is to be replaced or another sheet is to be provided or taken out the bars 22, 24 are moved apart with the elastic bands slacked off so that there is an elongated gap or space between the free ends of the opposite pins 26, 28. The appropriate drawing sheet then is removed or replaced. If convenient, the drawing sheets 40, which are not to be removed or replaced, are moved towards the particular bar 22 or 24 as the case may be and in the space thus provided between the opposites pins 36, 38 a new drawing sheet can be inserted.

FIG. 2 shows the bars 22, 24 in slightly withdrawn position so as to have the free ends of the pins 36, 38 away from the opposite bars 22, 24 as the case may be. In dotted lines the bar 24 is shown in the position withdrawn fully from the bar 22.

FIG. 3 shows a perspective view of a support frame 42 on which the bars 22, 24 are supported so that the drawings 40 can hang down as shown.

In FIG. 4 one type of guide means is shown. Here a tube or cylinder 44 is connected at the end of the bar 22. A complementary shaft 46 is connected at the end of the bar 24. The shaft 46 is adapted to slide into the tube 44 for guiding the two bars 22, 24 together. Similarly a tube and shaft are provided at the other end of the bars 22, 24.

Referring to FIGS. 5 and 6 a support for the bars 22.1, 22.4 of device 20.1 is illustrated. This support is in the form of a U-shaped channel section 48 connected to a support member 50, e.g. a shelf, table top, etc. The device 20.1 is shown to slide into the U-shaped support member 48 so as to rest on its legs 52, 54 directed towards each other. FIG. 6 shows a plan view on the device in FIG. 5 with the bars 22, 24 protruding from the channel 52 and being held together by means of a locking or biassing member 56.

In FIG. 7 a side view of one type of pin 58 is shown. This pin 58 is provided with a threaded part 60, a smooth shank 62, a pointed end 64, a head 66 and a locking nut 68. In FIGS. 8 to 11 various types of connections of the pin 58 are shown. In FIG. 8 the pin 56 is connected by turning into a screw threaded hole 70 of a bar 72. In FIG. 9 the bar is in the form of a channel 74, which is of oval shape with a gap 76 and has a hole 78 for receiving the pin 58, which is connected thereto by means of the nut 68. In FIG. 10, the channel 80 is of rectangular shape with inclined sides flanking the channel. A threaded hole is provided in the channel sides 82, 84 for receiving the threaded end of the pin 62. In FIG. 11 the bar 86 is of square hollow section and has threaded holes 88 and 90 for receiving the threaded part of the pin 58.

Referring to FIG. 12, an end locking fastener is shown. The fastener 92 has a disc shaped head 94 and an opposite rounded head 96. The fastener 92 is adapted to be pressed into slots provided in the bars 98, 100. The dimensions may be such so as to provide a tight fitting. Also one end (e.g. head 94) may fit through a hole in one bar and the opposite head (e.g. 96) may fit into a slot.

In FIG. 13 an end cap 102 for two bars 104, 106 is shown. The cap 102 has a lug and thumb marker 108 and fits over the ends of the bars 104, 106. A locating knob 110 fits into a hole 112 provided at the end of the bar 106. The cap 102 may have locating ridges 114, 116 which fit over support bars or rails 118, 120.

FIGS. 14 and 15 show a further possibility of providing a pin. In this case the bar 122 is of channel C-shape with a longitudinal gap 124. The pin 126 is provided in a solid base 128 fitting slidably into the bar 122. The pin 126 may be of aluminum and may be placed into a nylon or other synthetic material base 128. Thus the pin 126 can be moved along the bar 122 to any desired position.

FIG. 16 shows one biassing connection arrangement. Here two threaded bolts 130 and 132 receive a coil spring 134. The threaded bolts 130, 132 are moved through holes and into slots provided at the free ends of bars. The coil spring 134 tightly fits on the bolts 130, 132 as shown in the drawings.

FIGS. 17 and 18 show another method of joining the bars 136 and 138 in a biassed fashion. A flexible member 140, comprising elements 142 and 144 joined together, is placed with its ends 146 and 148 into the open ends of hollow bars 136 and 138. The bars 136 and 138 then can be moved away from each other by partially pulling out the flexible member 140; the resiliency of the elements 142, 144 will always draw the bars together when the flexible member 140 is pushed into the ends of the hollow bars 136 and 138.

I claim:

1. A suspension device for vertical suspension of sheets, such as drawing sheets, which includes (a) two hollow elongated bars, each bar having a longitudinal slot the sides of which are shaped to retain a block longitudinally slidably inside the bar;

(b) a number of blocks independently slidably provided in each bar;

(c) at least one pin allocated to each block, each pin being connected at one end to its block and the pin passing through the longitudinal slot of the bar in which its block is slidably provided with its opposite free end being directed towards the longitudinal slot of the other bar, each pin being adapted to be inserted through one of a series of holes provided along edges of sheets so that the sheets can suspend from the pins;

(d) locating means provided on each bar for receiving and locating the free ends of the pins of the other bar; and (e) locking means for releasably holding the two bars in a locked position in which the free ends of the pins are located in the associated locating means.

2. A device as claimed in claim 1, in which the longitudinal slot of each bar constitutes the locating means for receiving the free ends of the pins provided on blocks in the opposite bar.

3. A device as claimed in claim 1, in which the locking means include biasing means for biasing the two bars towards each other.

4. A device as claimed in claim 3, in which the biasing means is adapted to allow movement of the bars from a closed position in which the free ends of the pins are located in the locating means, into an open position, in which the bars are separated from each other at such a distance that there is a gap between the free ends of the pins provided on one bar and the pins provided on the other bar.

* * * * *